US009004959B2

(12) United States Patent
Soo

(10) Patent No.: US 9,004,959 B2
(45) Date of Patent: Apr. 14, 2015

(54) ELECTRICAL CONNECTING DEVICE

(71) Applicant: Molex Incorporated, Lisle, IL (US)

(72) Inventor: Foong-Ching Soo, Singapore (SG)

(73) Assignee: Molex Incorporated, Lisle, IL (US)

( * ) Notice: Subject to any disclaimer, the term of this patent is extended or adjusted under 35 U.S.C. 154(b) by 257 days.

(21) Appl. No.: 13/724,114

(22) Filed: Dec. 21, 2012

(65) Prior Publication Data

US 2013/0171893 A1 Jul. 4, 2013

(30) Foreign Application Priority Data

Dec. 30, 2011 (SG) ..... 201109778

(51) Int. Cl.

| | |
|---|---|
| ***H01R 13/02*** | (2006.01) |
| ***H01R 9/24*** | (2006.01) |
| ***H01R 12/00*** | (2006.01) |
| ***H01R 12/57*** | (2011.01) |
| ***H01R 43/02*** | (2006.01) |
| *H01R 12/71* | (2011.01) |

(52) U.S. Cl.

CPC ..... *H01R 9/091* (2013.01); *H01R 12/57* (2013.01); *H01R 43/0256* (2013.01); *H01R 12/718* (2013.01)

(58) Field of Classification Search

USPC ..... 439/885, 720, 884, 65, 68, 71, 72, 79, 439/83, 876; 29/827, 876, 748

See application file for complete search history.

(56) References Cited

U.S. PATENT DOCUMENTS

| | | | | | |
|---|---|---|---|---|---|
| 4,978,307 | A | * | 12/1990 | Billman et al. | 439/83 |
| 6,077,095 | A | * | 6/2000 | DelPrete et al. | 439/92 |
| 6,139,377 | A | * | 10/2000 | Chen | 439/885 |
| 2003/0220025 | A1 | * | 11/2003 | Peng et al. | 439/885 |

FOREIGN PATENT DOCUMENTS

| | | |
|---|---|---|
| TW | M389953 | 10/2010 |
| TW | M390560 | 10/2010 |
| TW | M421616 | 1/2012 |

* cited by examiner

*Primary Examiner* — Abdullah Riyami
*Assistant Examiner* — Harshad Patel
(74) *Attorney, Agent, or Firm* — Stephen L. Sheldon

(57) ABSTRACT

An electrical connecting device includes an electrical connecting member including an electrical connecting element and a removable component connecting to the electrical connecting element. The electrical connecting element includes a base portion extending on a plane, two connecting portions formed on the base portion, and an arm portion extending between the two connection portions. The removable component includes a plurality of finger portions each connecting to one connecting portion of each adjacent electrical connecting element at a connection that is configured to be breakable. A supporting element respectively extend from the end portions of two outermost ones of the finger portions of the comb element and extend adjacent to the plane and beside the arm portions of the electrical connecting elements.

13 Claims, 19 Drawing Sheets

ELECTRICAL CONNECTING DEVICE

RELATED APPLICATIONS

This application claims priority to Singapore Application No. 201109778-9, filed Dec. 30, 2011, which is incorporated herein by reference in its entirety.

TECHNICAL FIELD

The present invention relates to an electrical connecting device.

BACKGROUND ART

In order to reduce the size of electrical connectors, one type of electrical connector without an insulative body for holding terminals has been developed, an example of which is shown in FIG. 1. In the electrical connector 1 disclosed in Taiwan Utility Model Patent Number M390560 and shown in FIG. 1, a plurality of terminals 13 are arrayed on a printed circuit board 12 receivable in a metal shell 11. The plurality of terminals 13 are directly soldered to the printed circuit board 12 without using an insulating housing to hold them so that no space for accommodating the insulative housing is required, thereby reducing the height of the electrical connector 1.

The printed circuit board 12 has two rows of soldering pads 14, and the plurality of terminals 13 are respectively soldered onto the soldering pads 14. Traditionally, the terminals 13 may be soldered to the corresponding soldering pads 14 one after another by a pick and place operation. However, such an assembly process is time-consuming, particularly when there are many terminals 13 to be soldered.

Moreover, with continuing reduction of the sizes of electronic devices, the terminals 13 are being made smaller and smaller. Smaller terminals 13 are more difficult to pick and place, bringing a new challenge to the manufacturing of such type of electrical connectors.

SUMMARY OF THE INVENTION

In accordance with the above objectives, one embodiment proposes an electrical connecting device, which may comprise at least one electrical connecting member. The electrical connecting member may comprise a plurality of electrical connecting elements and a removable component. The plurality of electrical connecting elements may be arranged along a line 10 and comprise a base portion, two connecting portions, and an arm portion. The base portion may comprise opposite first and second edges. The connecting portions may respectively be formed on the opposite ends of the first edge. The arm portion may extend from a location between the opposite ends of the first edge. The arm portion may be further configured 15 to extend upward and along a direction from the second edge to the first edge. The arm portion may comprise a contact part with a contact surface facing upward. The removable component may comprise a comb element and two supporting elements. The comb element may comprise a body portion and a plurality of parallel finger portions extending from the body portion. Each finger portion connects to one of the connecting portions of each adjacent one of the electrical connecting elements at a connection that is configured to be breakable. The supporting elements may respectively extend from the end portions of two outermost ones of the finger portions of the comb element and along the direction from the second edge to the first edge. The body portion of the comb element may be above the two supporting elements. The base portion of the electrical connecting element may extend on a plane, and the supporting elements extend adjacent to the plane.

An electrical connecting device of another embodiment may comprise at least one electrical connecting member, which comprises a plurality of electrical connecting elements (arranged along line) and a removable component. Each electrical connecting element comprises a base portion comprising opposite first and second edges, two extending portions bent upward and respectively extending adjacent to opposite ends of the first edge, two connecting portions formed respectively on ends of the two extending portions, and an arm portion extending from a location between the opposite ends of the first edge. The arm portion may extend upward and along a direction from the second edge to the first edge and comprise a contact part with a contact surface facing upward. The removable component may comprise a comb element and two supporting elements. The comb element may comprise a body portion and a plurality of parallel finger portions extending from the body portion. Each finger portion may connect to one of the connecting portions of each adjacent one of the electrical connecting elements at a connection that is configured to be breakable. The supporting elements may respectively extend from the end portions of two outermost ones of the finger portions of the comb element and along the direction from the second edge to the first edge. The body portion of the comb element may be under the two supporting elements. The base portion of the electrical connecting element may extend on a plane, and the supporting elements may extend adjacent to the plane.

To better understand the above-described objectives, characteristics and advantages of the present invention, embodiments, with reference to the drawings, are provided for detailed explanations.

BRIEF DESCRIPTION OF THE DRAWINGS

The invention will be described according to the appended drawings in which.

DETAILED DESCRIPTION OF THE PREFERRED EMBODIMENTS

Figure 1:
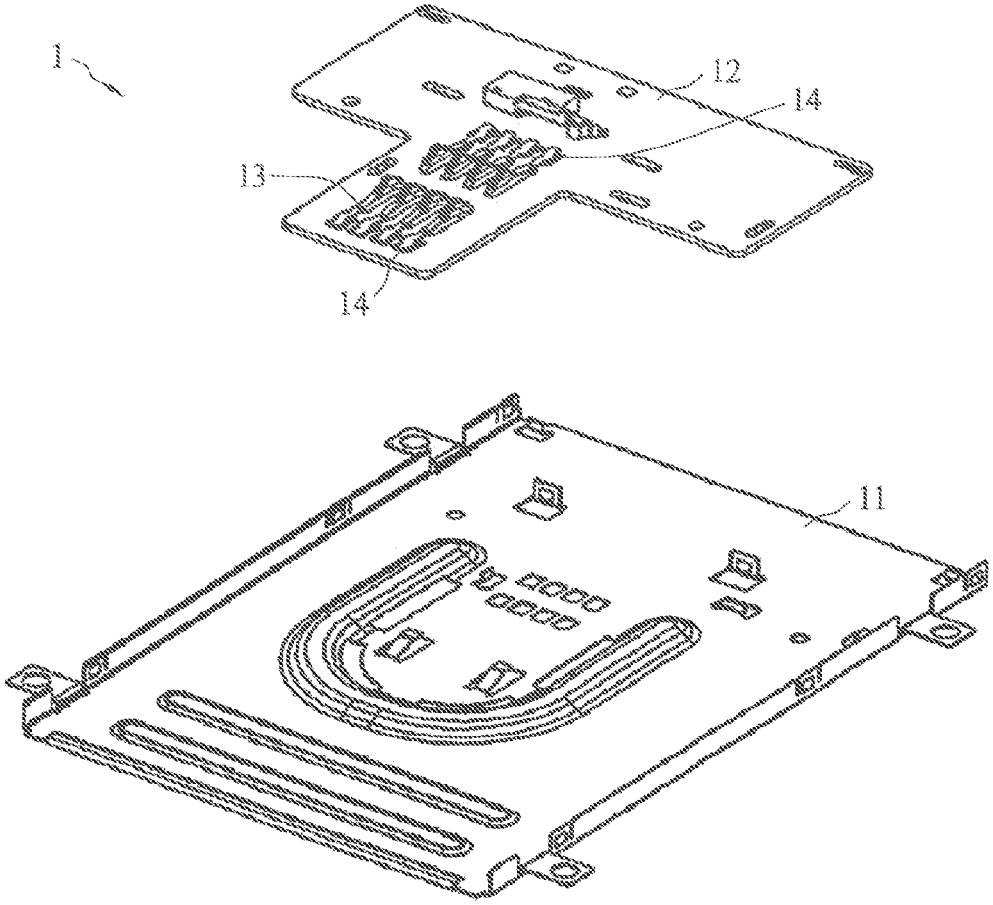
FIG. 1 (Prior Art)
FIG. 1 shows a conventional electrical connector.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. One objective is to provide an electrical connecting device comprising a plurality of electrical connecting elements that can be installed simultaneously. Another objective is to provide a free-standing electrical connecting device.

It should be noted that in this description, representations of directions such as up, down, left, right, front, rear, and the like, used for explaining the structure and movement of each part of the disclosed embodiment are not intended to be absolute, but rather are relative. These representations are appropriate when each part of the disclosed embodiment is in the position shown in the figures. If the position or frame of reference of the disclosed embodiment changes, however, these representations are to be changed according to the change in the position or frame of reference of the disclosed embodiment.

Figure 2:
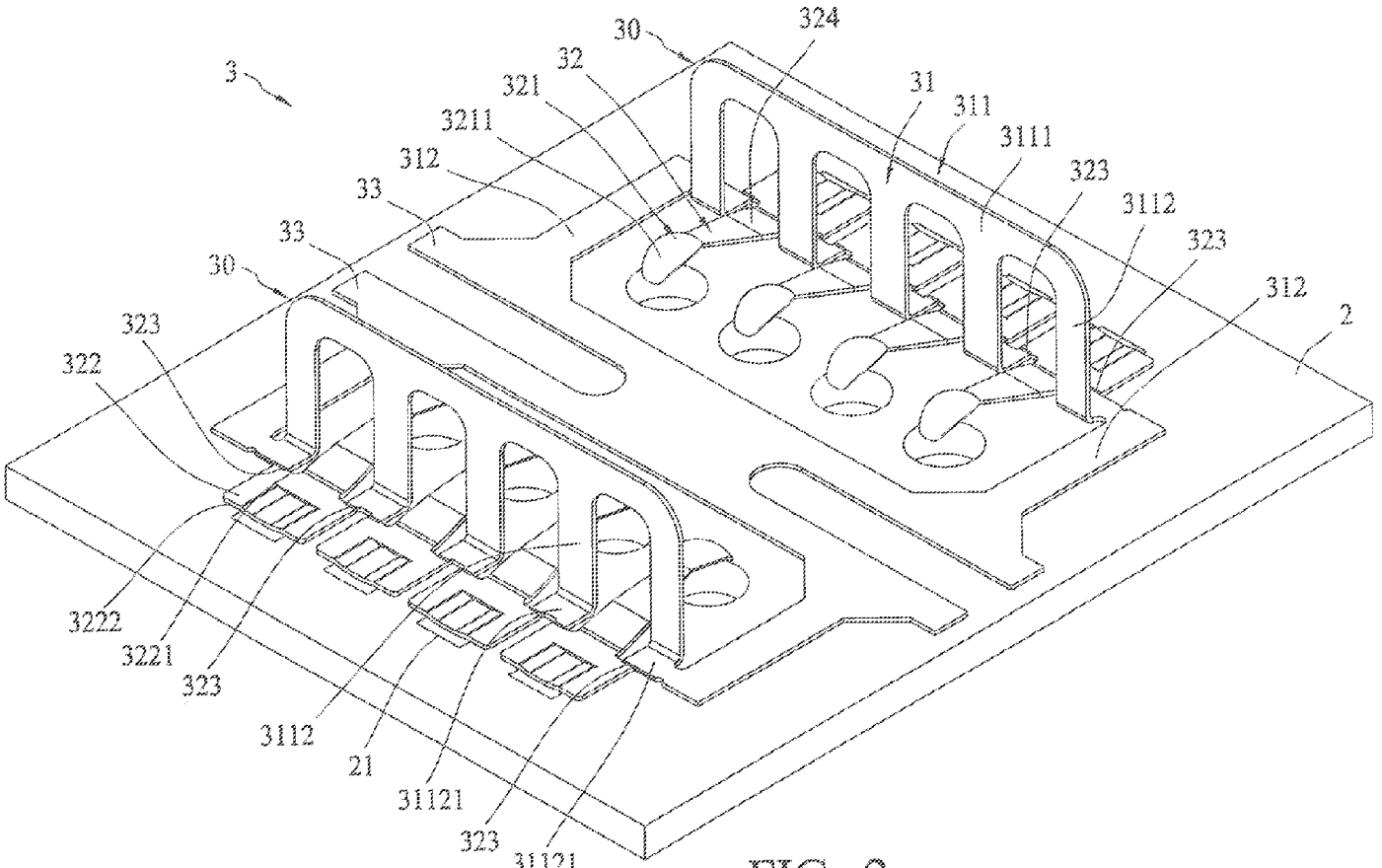
FIG. 2 is a schematic perspective illustration depicting an electrical connecting device mounted on a printed circuit board according to one embodiment.
Figure 3:
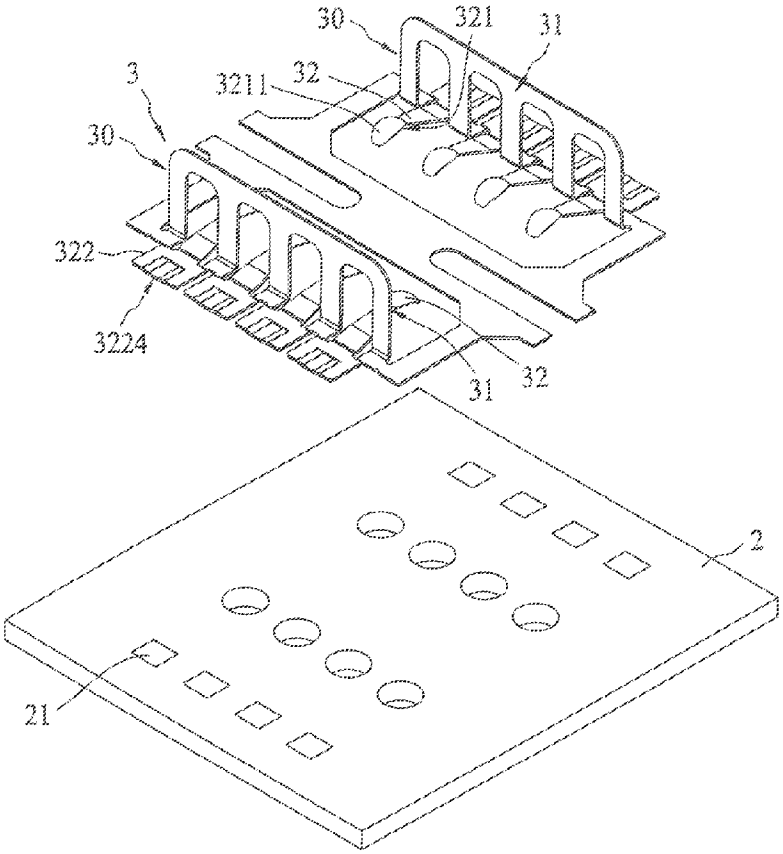
FIG. 3 is a schematic perspective illustration depicting a printed circuit board and an electrical connecting device separated from the printed circuit board according to one embodiment.
Figure 4A:
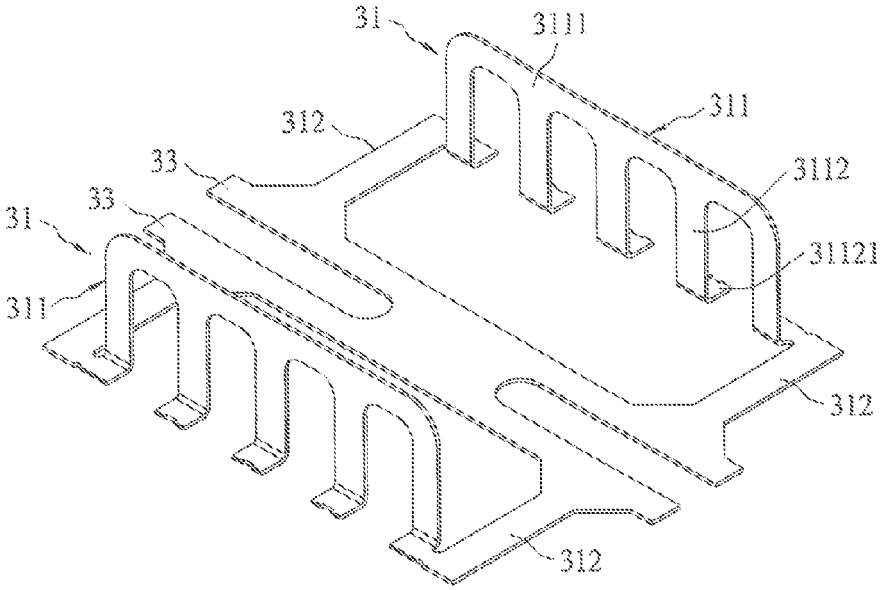
FIG. 4A is a schematic perspective illustration depicting a removable component according to one embodiment.
Figure 4B:
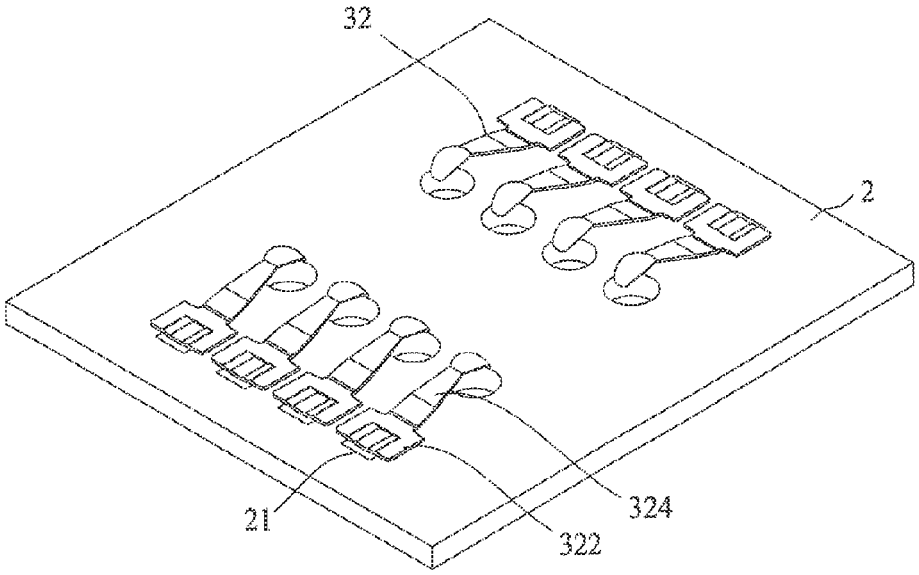
FIG. 4B is a schematic perspective illustration depicting a plurality of electrical connecting elements soldered to the printed circuit board according to one embodiment.

FIG. 2 is a schematic perspective illustration depicting an electrical connecting device 3 mounted on a printed circuit board 2 according to one embodiment. FIG. 3 is a schematic perspective illustration depicting a printed circuit board 2 and an electrical connecting device 3 separated from the printed circuit board 2 according to one embodiment. FIG. 4A is a schematic perspective illustration depicting a removable component 31 according to one embodiment. FIG. 4B is a schematic perspective illustration depicting electrical connecting elements 32 soldered to the printed circuit board 2 according to one embodiment. Referring to FIGS. 2 and 3, the electrical connecting device 3 may be a top mount electrical connecting device. The electrical connecting device 3 comprises, but is not limited to, two electrical connecting members 30, each comprising a removable component 31 and a plurality of electrical connecting elements 32. The plurality of electrical connecting elements 32 connect to the removable component 31 such that the plurality of electrical connecting elements 32 can be simultaneously placed onto the printed circuit board 2 and then soldered. Consequently, the assembly process for attaching the electrical connecting device 3 to the printed circuit board 2 takes less time and is more efficient than previous methods.

In some embodiments, the electrical connecting device 3 may comprise at least one electrical connecting member 30. The electrical connecting element 32 can have a contact part 321 comprising a contact surface 3211 that may face, but is not limited to facing, upward for contacting a contact pad formed on an electronic device that is intended to be in electrical connection with the printed circuit board 2.

As can be seen in FIG. 3, each electrical connecting element 32 may comprise a base portion 322, which comprises, in the present embodiment, a bottom surface configured as a soldering surface 3224 facing downward for surface mount solder attachment. Correspondingly, the printed circuit board 2 comprises a plurality of contact pads 21. After the electrical connecting member 30 is placed on the printed circuit board 2, the soldering surface 3224 of each electrical connecting element 32 is on the corresponding contact pad 21, prepared for being soldered thereon. In some embodiments, a part of the base portion 322 of the electrical connecting element 32 can be pressed down to form the soldering surface 3224.

The electrical connecting member 30 may comprise, but is not limited to, a plurality of electrical connecting elements 32 that are arranged along a line as shown in FIGS. 2 and 3. Correspondingly, the contact pads 21 on the printed circuit board 2 are arranged in a line.

Figure 5:
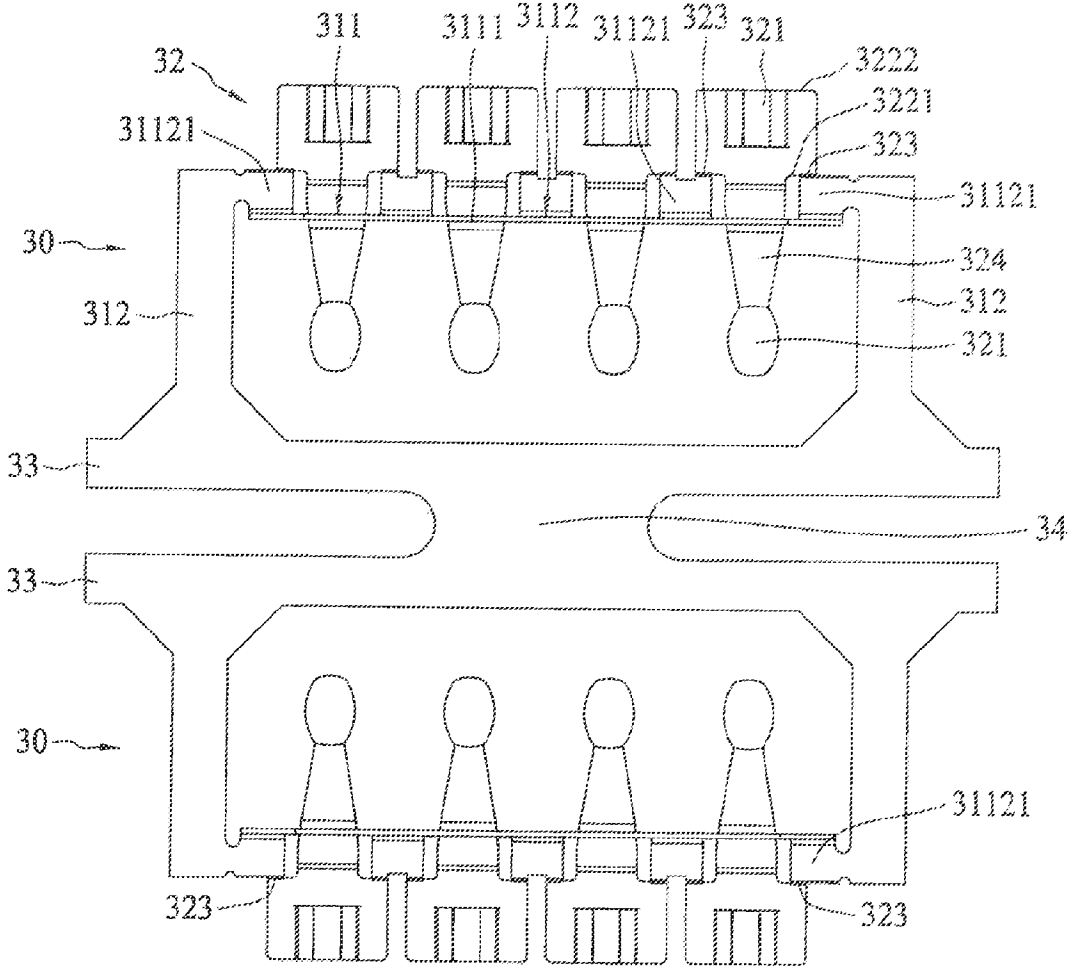
FIG. 5 is a top view showing an electrical connecting device according to one embodiment.

Referring to FIGS. 3 and 5, the base portion 322 of each electrical connecting element 32 may comprise first and second edges 3221 and 3222. Each electrical connecting element 32 may further comprise two connecting portions 323 and an arm portion 324. In some embodiments, the two connecting portions 323 may respectively be formed on the opposite ends of the first edge 3221. The arm portion 324 may extend from a location on the first edge 3221 between the opposite ends of the first edge 3221. The arm portion 324 may extend upward and along a direction from the second edge 3222 toward the first edge 3221.

As shown in FIGS. 2, 4A and 4B, the removable component 31 is configured to connect with the electrical connecting elements 32 and to be easily separated from the electrical connecting elements 32. The removable component 31 may comprise a comb element 311 and two supporting elements 312. The comb element 311 may comprise a body portion 3111 and a plurality of parallel finger portions 3112 extending from the body portion 3111. As shown in FIGS. 3 and 5, each finger portion 3112 may comprise an end portion 31121, which is bent, for example, perpendicularly and connects to one connecting portion 323 of each adjacent electrical connecting element 32 at a connection. The connection is processed for reducing its strength such that the connection is breakable and can be broken to separate the removable component 31 from the electrical connecting elements 32 as shown in FIGS. 4A and 4B. In some embodiments, the connection may comprise at least one notch or at least one cut. In some embodiments, the connection may comprise at least one V-shaped groove.

The electrical connecting device 3 is configured to be free-standing on the printed circuit board 2 after it is placed on the printed circuit board 2, as shown in FIG. 2. The two supporting elements 312 can be disposed, but are not limited to being disposed, on two opposite sides of the electrical connecting device 3. The supporting element 312 is generally, but not exclusively, configured to provide a free-standing support to the electrical connecting device 3 such that the electrical connecting device 3 can be freestanding on the printed circuit board 2 after it is placed on the printed circuit board 2. As illustrated in FIGS. 4A and 5, in some embodiments, the two supporting elements 312 respectively extend from the end portions 31121 of two outermost finger portions 3112 of the corresponding comb element 311. The supporting elements 312 can extend in the direction from the corresponding second edge 3222 toward the corresponding first edge 3221. As can be seen more clearly in FIG. 5, the supporting element 312 extends past the comb element 311 from one side of the comb element 311 to the other side where most portions of the arm portions 324 and the contact parts 321 of the electrical connecting elements 32 are located (e.g. beside the arm portions 324), and at such location provides additional support to prevent the contact parts 321 of the electrical connecting elements 32 from tipping. Because the supporting element 312 extends past the comb element 311, the body portion 3111 and the finger portions 3112 are above a region extending between the supporting elements 312. In some embodiments, the two supporting elements 312 may extend only at a side of the comb element 311.

As shown in FIG. 2, in some embodiments, the base portions 322 of the electrical connecting elements 32 and the supporting elements 312 may be formed adjacent to the plane. As such, when the electrical connecting device 3 is placed on the printed circuit board 2, the base portions 322 of the electrical connecting elements 32 and the supporting elements 312 are simultaneously against the printed circuit board 2, providing a free-standing support.

In some embodiments, the electrical connecting device 3 comprising at least one electrical connecting member 30 may further comprise a plate member 33, which is configured to connect the two supporting elements 312 of the removable component 31 to form a frame portion.

In the present embodiment, as shown in FIG. 5, the electrical connecting device 3 may comprise two plate members 33 corresponding to the two removable components 31. Each plate member 33 is configured to connect the two supporting elements 312 of the corresponding removable component 31 to form a frame portion. Moreover, in some embodiments, the plate members 33 are connected. In some embodiments, the connected plate members 33 form a connected section 34 that can be used for a pick-and-place operation.

Figure 6:
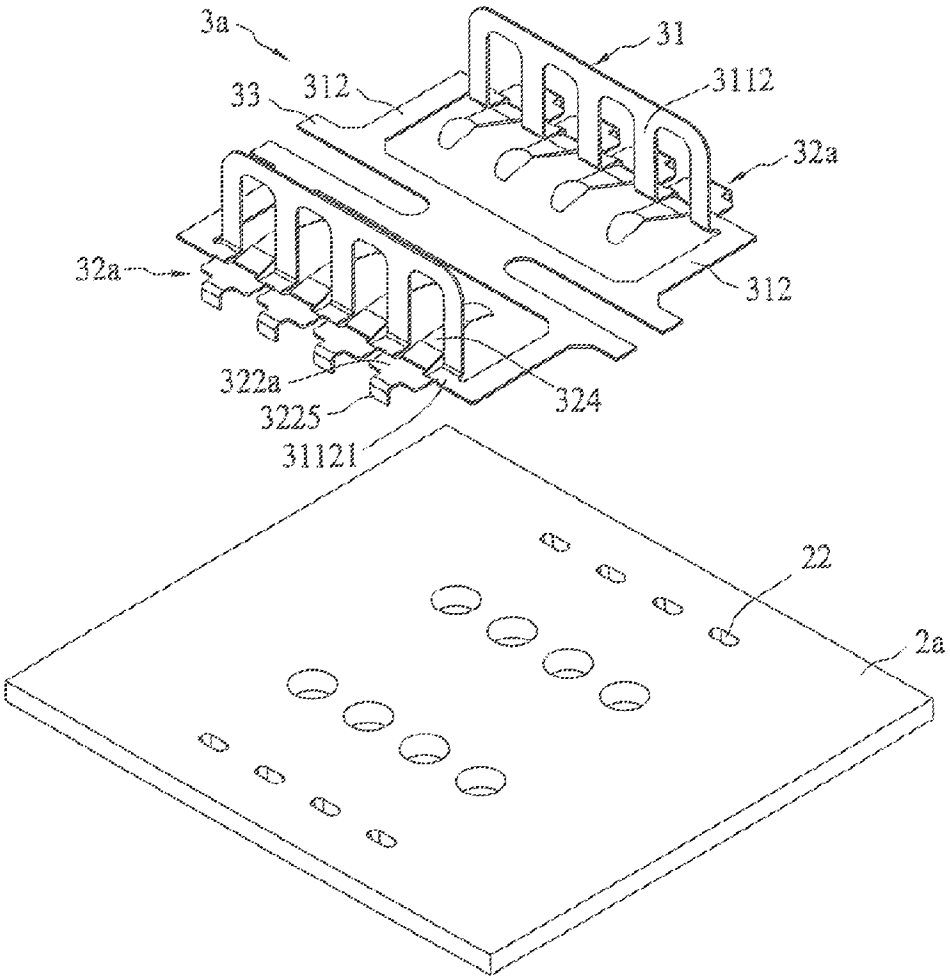
FIG. 6 is a schematic perspective illustration depicting an electrical connecting device mountable on a printed circuit board according to another embodiment.

FIG. 6 is a schematic perspective illustration depicting an electrical connecting device 3*a* mountable on a printed circuit board 2*a* according to another embodiment. As shown in FIG. 6, the electrical connecting device 3*a* is similar to the electrical connecting device 3 of the embodiment shown in FIG. 3 except that in FIG. 6 the electrical connecting element 32*a* comprises a base portion 322*a*, which comprises a bent soldering part 3225. Correspondingly, the printed circuit board 2*a* is formed with a plurality of plated through-holes 22, each configured to receive the respective bent soldering part 3225. After the bent soldering parts 3225 of the electrical connecting elements 32*a* are soldered in the corresponding through-holes 22, the removable components 31 are removed and the electrical connecting elements 32*a* are left on the printed circuit board 2*a*.

Figure 7:
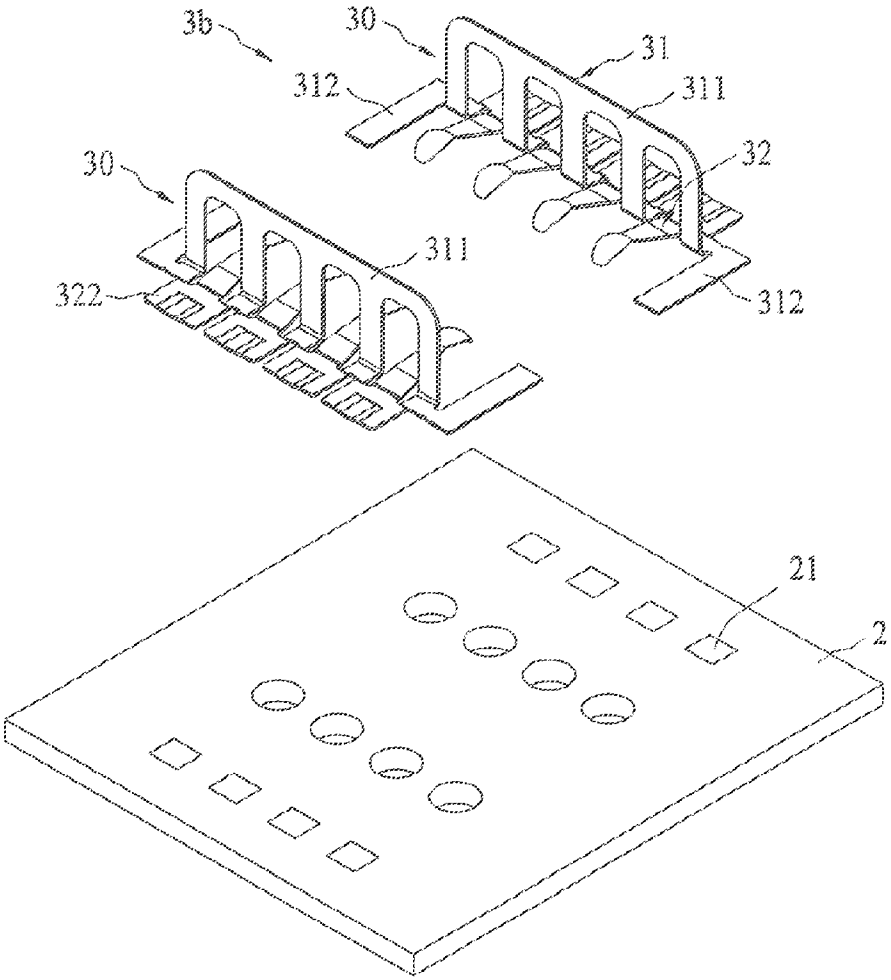
FIG. 7 is a schematic perspective illustration depicting an electrical connecting device mountable on a printed circuit board according to another embodiment.

FIG. 7 is a schematic perspective illustration depicting an electrical connecting device 3*b* mountable on a printed circuit board 2 according to another embodiment. As shown in FIG. 7, the electrical connecting device 3*b* is similar to the electrical connecting device 3 of the embodiment shown in FIG. 3. The difference between the two is that in FIG. 7, the electrical connecting device 3*b* does not comprise the plate members 33. Thus, the electrical connecting device 3*b* comprises two distinct electrical connecting members 30.

Figure 8:
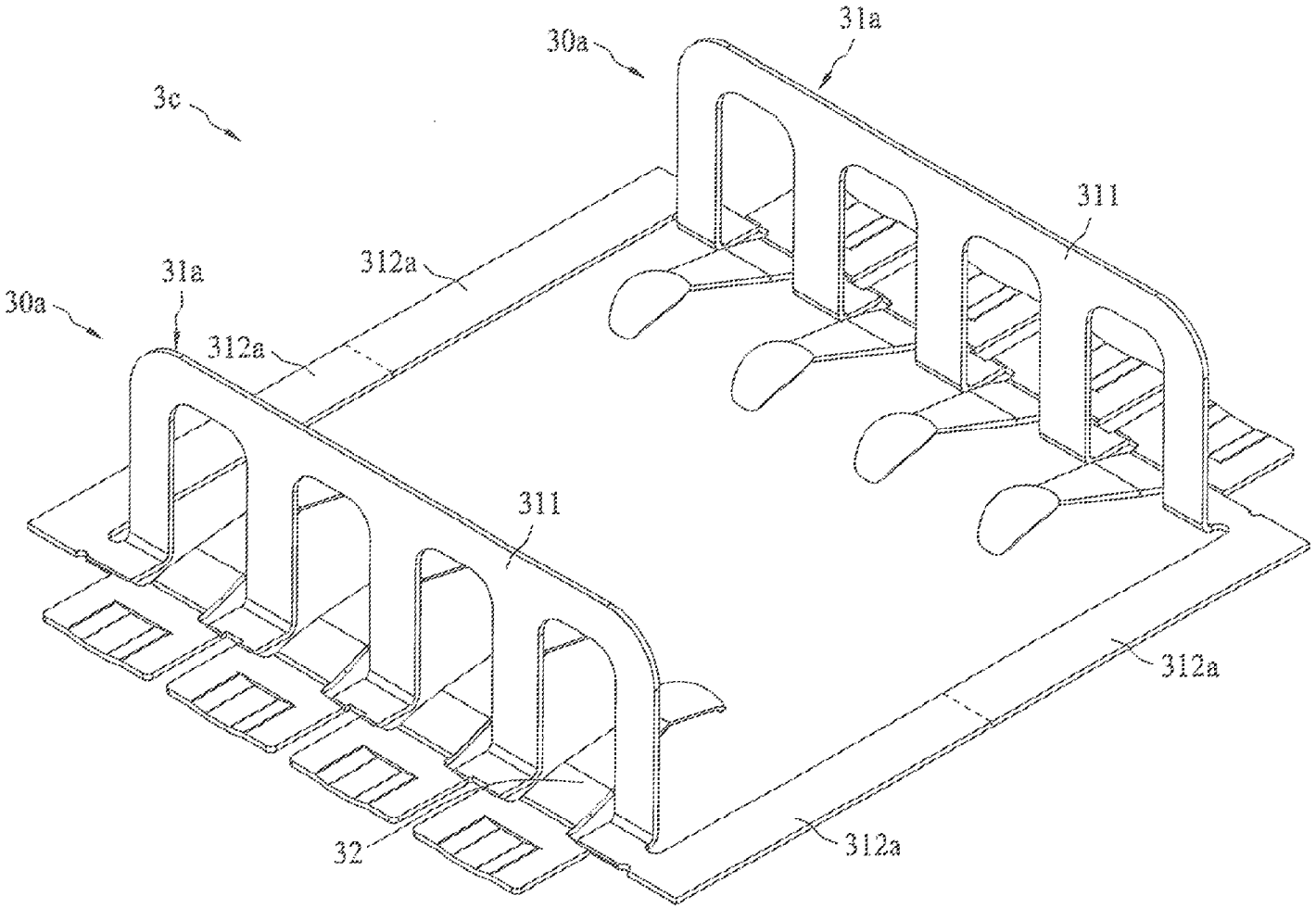
FIG. 8 is a schematic perspective illustration depicting an electrical connecting device according to another embodiment.

FIG. 8 is a schematic perspective illustration depicting an electrical connecting device 3*c* according to another embodiment. As shown in FIG. 8, the electrical connecting device 3*c* comprises two electrical connecting members 30*a*. The electrical connecting members 30*a* are similar to the electrical connecting members 30 of the electrical connecting device 3*b* of the embodiment shown in FIG. 7, except that in FIG. 8, each of the supporting elements 312*a* of the removable component 31*a* of one electrical connecting member 30*a* may sufficiently extend and connect to a corresponding supporting element 312*a* of the removable component 31*a* of another electrical connecting member 30*a*.

Figure 9:
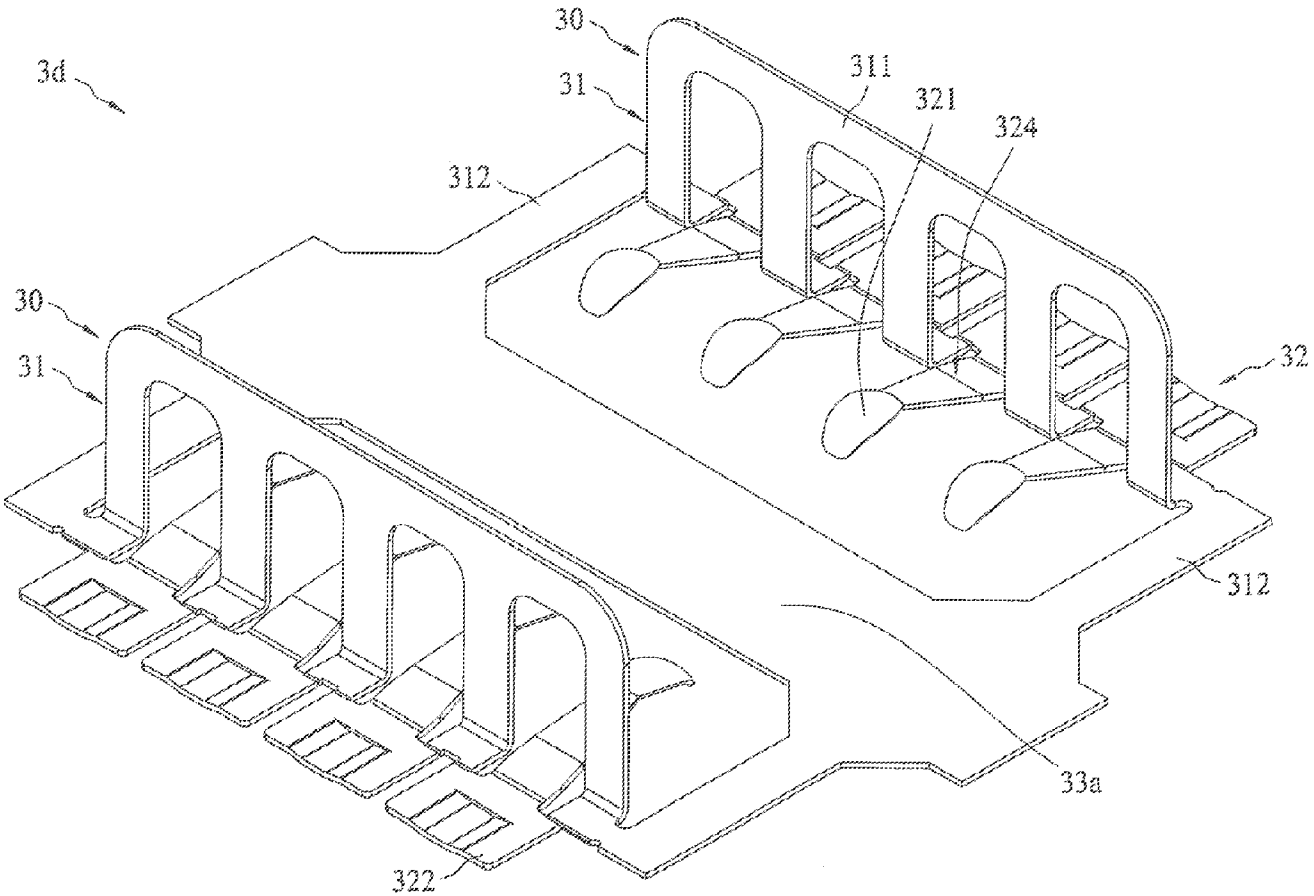
FIG. 9 is a schematic perspective illustration depicting an electrical connecting device according to another embodiment.

FIG. 9 is a schematic perspective illustration depicting an electrical connecting device 3*d* according to another embodiment. As shown in FIG. 9, the electrical connecting device 3*d* and the electrical connecting device 3 are similar, both comprising two electrical connecting members 30 each comprising a plurality of electrical connecting elements 32 and a removable component 31 comprising a comb element 311 and two supporting elements 312. The difference between the electrical connecting devices 3 and 3*d* is that the electrical connecting device 3*d* comprises only one plate member 33*a*, and the two supporting elements 312 of the two removable components 31 are attached to the plate member 33*a*.

Figure 10:
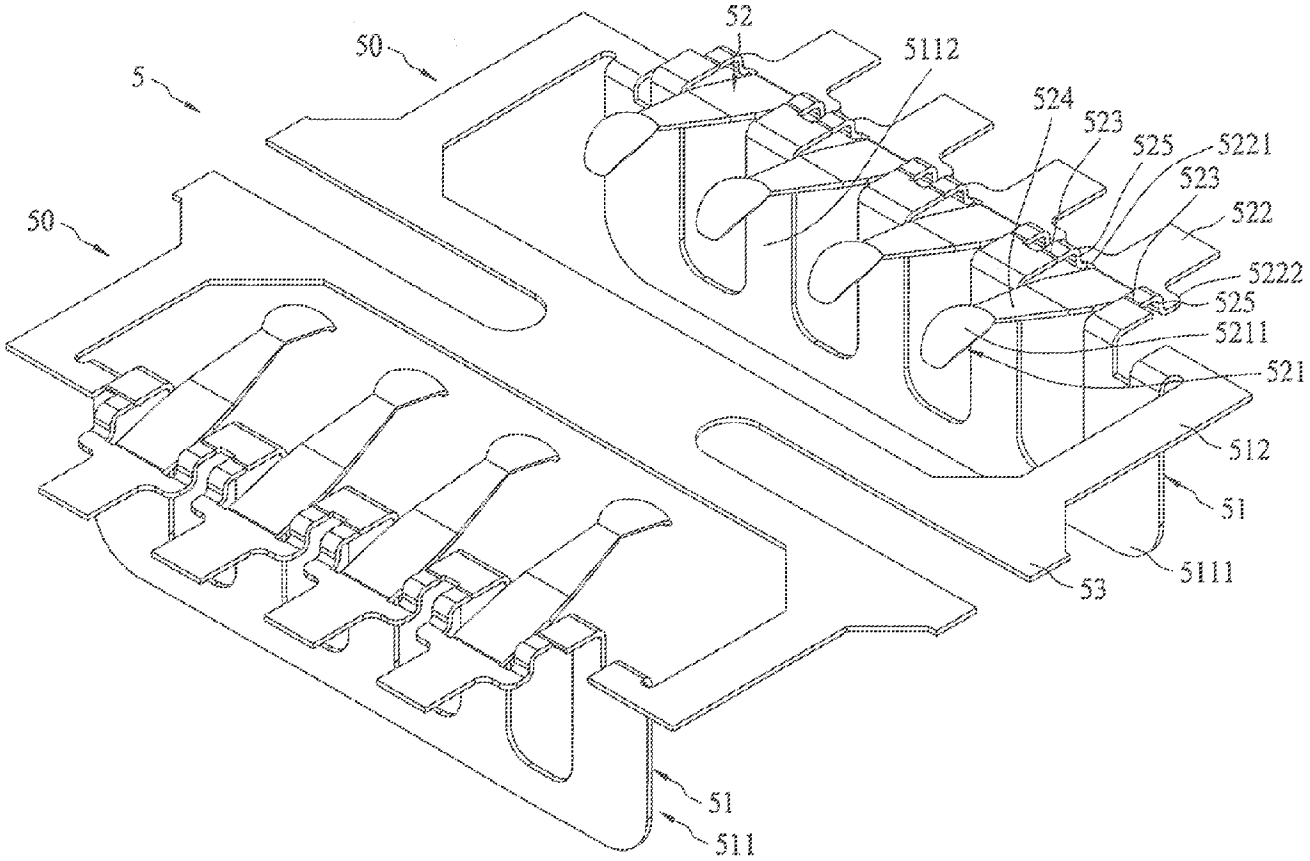
FIG. 10 is a schematic perspective illustration depicting a bottom mount type electrical connecting device according to one embodiment.
Figure 11:
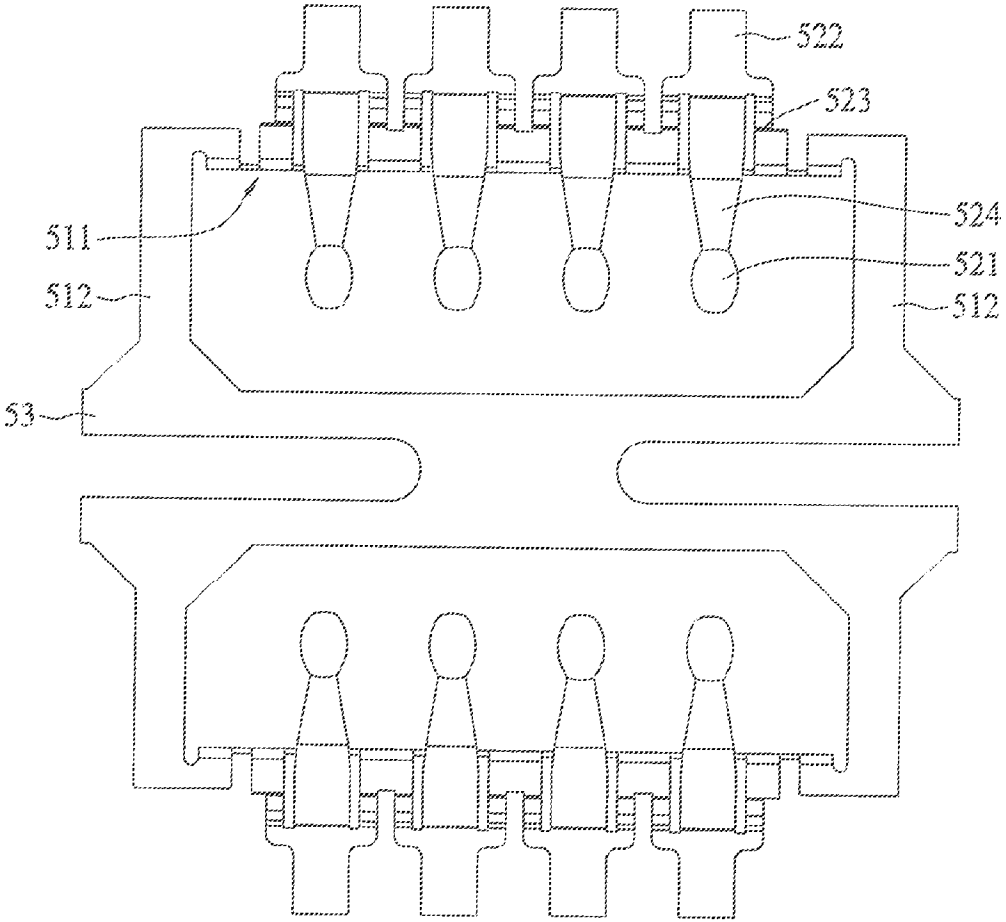
FIG. 11 is a top view of the bottom mount type electrical connecting device of FIG. 10.
Figure 12:
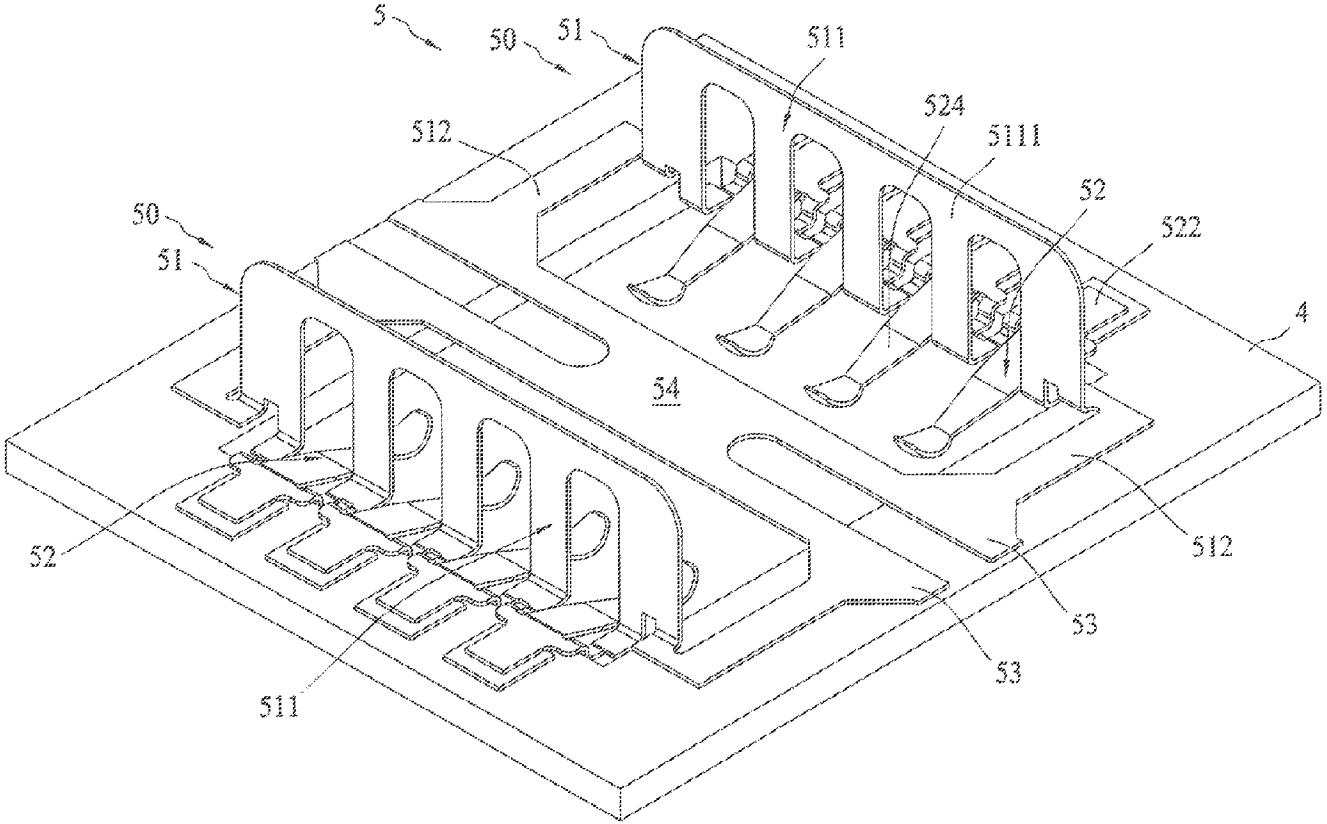
FIG. 12 is a schematic perspective illustration depicting a bottom mount type electrical connecting device installed on a bottom surface of a printed circuit board according to one embodiment.
Figure 13:
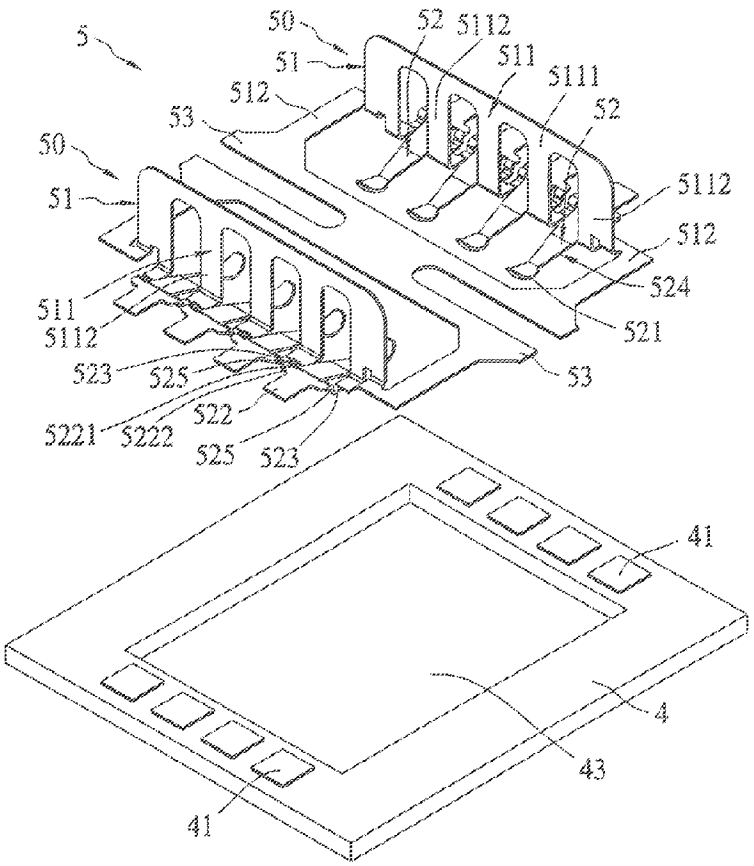
FIG. 13 is a schematic perspective illustration depicting a printed circuit board and a bottom mount type electrical connecting device separated from the printed circuit board according to one embodiment.
Figure 14:
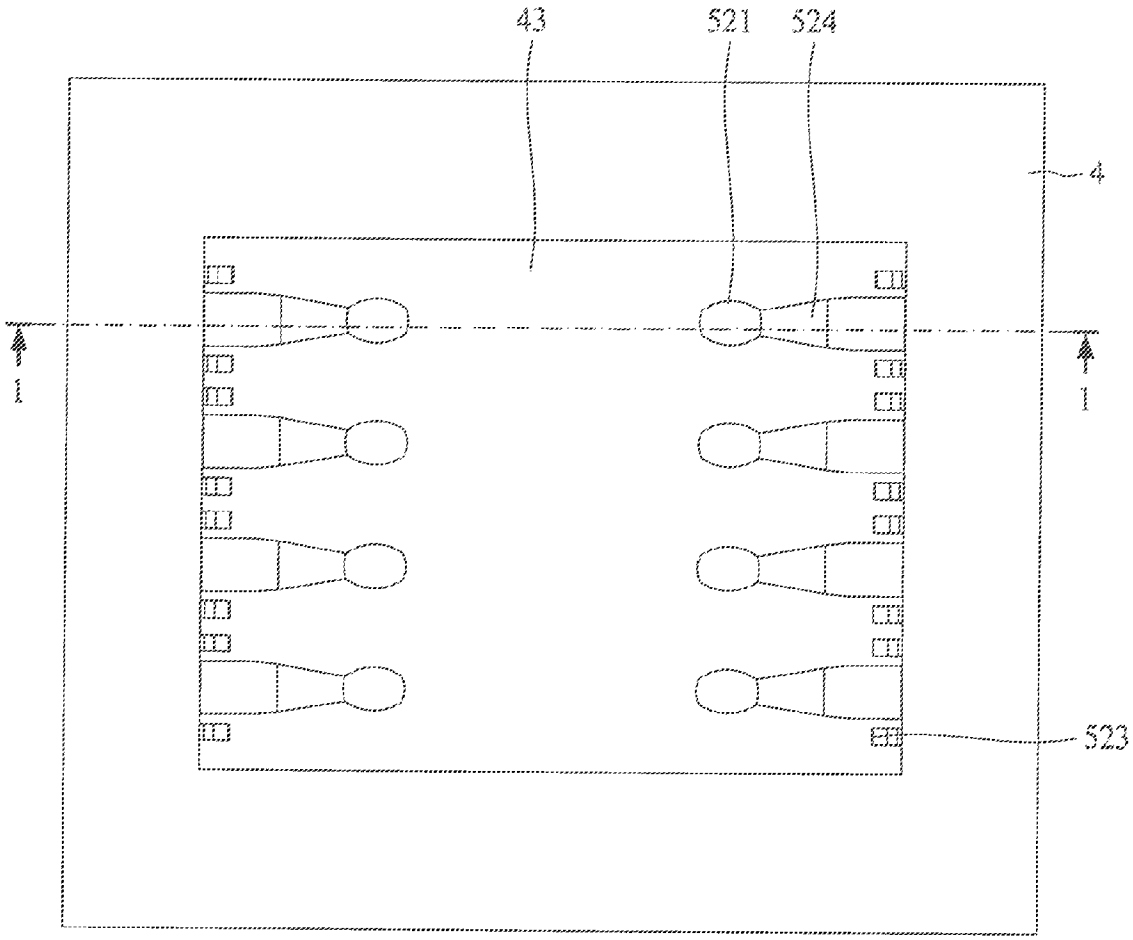
FIG. 14 is a schematic top view showing a plurality of electrical connecting members attached to a printed circuit board according to one embodiment.
Figure 15:
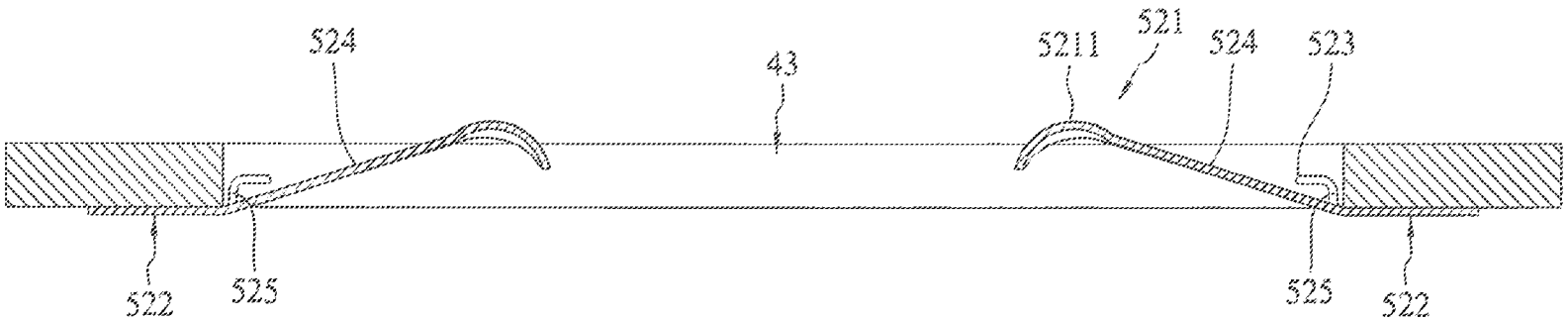
FIG. 15 is a cross-sectional view along line 1-1 of FIG. 14.

FIG. 10 is a schematic perspective illustration depicting a bottom mount type electrical connecting device 5 according to one embodiment. FIG. 11 is a top view of the bottom mount type electrical connecting device 5 of FIG. 10. FIG. 12 is a schematic perspective illustration depicting a bottom mount type electrical connecting device 5 installed on a bottom surface of a printed circuit board 4 according to one embodiment, and FIG. 13 is a schematic perspective illustration depicting a printed circuit board 4 and a bottom mount type electrical connecting device 5 separated from the printed circuit board 4 according to one embodiment. FIG. 14 is a schematic top view showing a plurality of electrical connecting members 50 attached to a printed circuit board 4 according to one embodiment. FIG. 15 is a cross-sectional view along line 1-1 of FIG. 14. In FIGS. 12 and 13, for explanation purposes, the electrical connecting device 5 is positioned upside-down and the printed circuit board 4 is turned over. Referring to FIGS. 10 to 13, the electrical connecting device 5 comprises, but is not limited to, two electrical connecting members 50, each comprising a removable component 51 and a plurality of electrical connecting elements 52. In each electrical connecting member 50, the plurality of electrical connecting elements 52 connect to the removable component 51 so that the assembly process for installing the electrical connecting device 5 to the printed circuit board 4 can be more efficient. In some embodiments, the electrical connecting device 5 may comprise one or more electrical connecting members 50.

Referring to FIGS. 10 and 12, the electrical connecting member 50 is configured as an electrical connection between an electronic device and the printed circuit board 4. In each electrical connecting member 50, the plurality of electrical connecting elements 52 may be arranged along a line. Each electrical connecting element 52 may comprise a base portion 522, two extending portions 525, two connecting portions 523, and an arm portion 524. Specifically, the base portion 522 may comprise opposite first and second edges 5221 and 5222. The two extending portions 525 respectively extend from or adjacent to two opposite ends of the first edge 5221. The two extending portions 525 are bent upward as best shown in FIG. 12. The two connecting portions 523 are formed respectively on the ends of the two extending portions 525. The arm portion 524 extends from a location on the first edge 5221 between the opposite ends of the first edge 5221. The arm portion 524 extends upward as best shown in FIG. 10 and along the direction from the second edge 5222 to the first edge 5221. The arm portion 524 may comprise a contact part 521 comprising a contact surface 5211 facing upward as best shown in FIG. 10. In some embodiments, the base portion 522 may comprise an upper surface configured as a soldering surface facing upward for surface mount solder attachment to a corresponding contact pad 41 on the bottom surface of the printed circuit board 4. In some embodiments, the extending portion 525 comprises an L-shaped arm part.

Referring to FIGS. 12 and 13, the removable component 51 may comprise a comb element 511 and two supporting elements 512. The comb element 511 may comprise a body portion 5111 and a plurality of parallel finger portions 5112 extending from the body portion 5111. Each finger portion 5112 comprises an end portion, which is bent and connects to one connecting portion 523 of each adjacent electrical connecting element 52 at a connection that is configured to be breakable whereby the removable component 51 can be separated from its corresponding electrical connecting elements 52 after the electrical connecting elements 52 are soldered. In some embodiments, the connection is processed for reducing its strength such that the connection is breakable. The connection may comprise at least one notch or at least one cut. In some embodiments, the connection may comprise at least one V-shaped groove.

As shown in FIGS. 10 to 13, the two supporting elements 512 respectively extend from the end portions of two outermost finger portions 5112 of the comb element 511 in the direction from the second edge 5222 to the first edge 5221. The two supporting elements 512 are configured to provide an additional free-standing support. In some embodiments, the two supporting elements 512 may extend past the comb element 511 (FIG. 11). Specifically, the two supporting elements 512 may extend from one side of the comb element 511 to the other side where most of the arm portions 524 and the contact parts 521 of the electrical connecting elements 52 are located (e.g. beside the arm portions 524), and there provides additional support to prevent the contact parts 521 of the electrical connecting elements 52 from tipping. In some embodiments, the two supporting elements 512 may extend only at a side of the comb element 511.

As shown in FIG. 10, in some embodiments, the base portions 522 of the electrical connecting elements 52 may extend on a plane. The supporting elements 512 may extend adjacent to the plane. As such, when the electrical connecting device 5 is placed on the printed circuit board 4, the base portions 522 of the electrical connecting elements 52 and the supporting elements 512 are against the printed circuit board 4, providing a free-standing support.

The electrical connecting device 5 comprises two plate members 53 corresponding to the two removable components 51. Each plate member 53 is configured to connect the two supporting elements 512 to form a frame portion. In some embodiments, the two plate members 53 are connected as shown in FIGS. 11 and 12. In some embodiments, the connected plate members 53 form a connected section 54 that can be used for a pick-and-place operation. In some embodiments, the electrical connecting device 5 comprising at least one electrical connecting member 50 may further comprise a plate member 53, which is configured to connect the two supporting elements 512 of the removable component 51 to form a frame portion.

As shown in FIGS. 10 to 15, the electrical connecting elements 52 are soldered to the contact pads 41 on the bottom surface of the printed circuit board 4. The printed circuit board 4 is configured to have a through-hole 43, and the contact pads 41 are disposed on opposite sides of the through-hole 43. When the electrical connecting elements 52 are to be soldered to the printed circuit board 4, the printed circuit board 4 is initially placed with its bottom surface facing upward. Next, the electrical connecting device 5 is turned upside down and placed on the printed circuit board 4 with the soldering surfaces of the base portion 522 of the electrical connecting elements 52 resting on the contact pads 41 and with the arm portions 524 extending through the through-hole 43 and the contact parts 521 protruding beyond the upper surface of the printed circuit board 4. Next, a soldering process is performed to solder the base portion 522 of the electrical connecting elements 52 to the contact pads 41. Finally, the removable component 51 is separated from the electrical connecting elements 52 by breaking the weakened connections.

Figure 16:
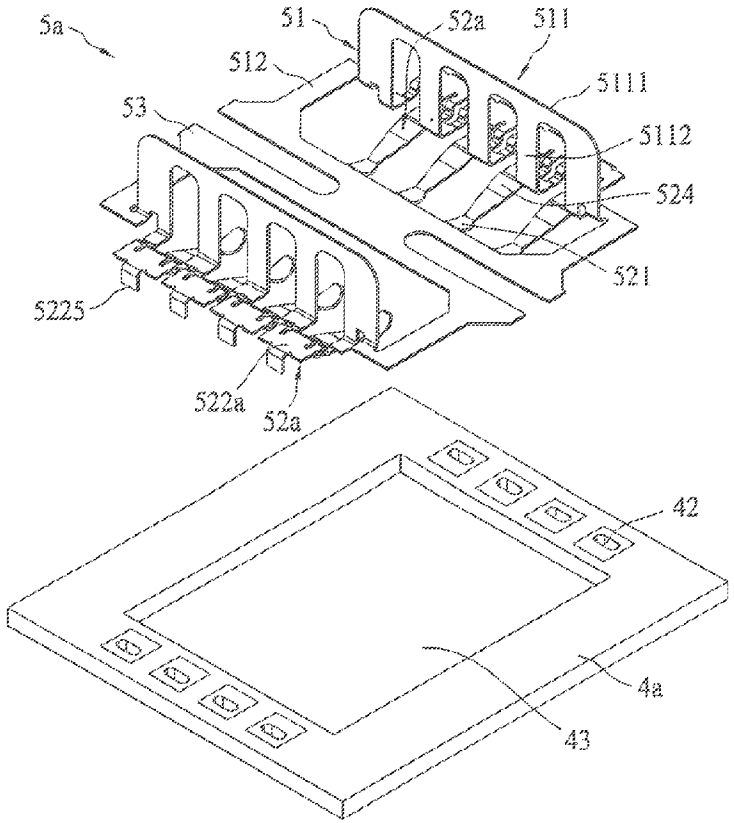
FIG. 16 is a schematic perspective illustration depicting an electrical connecting device mountable on a printed circuit board according to another embodiment.

FIG. 16 is a schematic perspective illustration depicting a bottom mount type electrical connecting device Sa mountable underneath a printed circuit board 4*a* according to another embodiment, wherein the electrical connecting device Sa is positioned upside down and the printed circuit board 4*a* is turned over with its bottom surface facing upward for explanation purposes. As shown in FIG. 16, the electrical connecting device 5*a* is similar to the electrical connecting device 5 of the embodiment shown in FIG. 11 except that the electrical connecting element 52*a* comprises a base portion 522*a*, which comprises a bent soldering part 5225. Correspondingly, the printed circuit board 4*a* is formed with a plurality of plated through-holes 42 each configured to receive the respective bent soldering part 5225. Similarly, the electrical connecting device 5*a* is placed on the bottom surface of an overturned printed circuit board 4*a* with the bent soldering parts 5225 of the electrical connecting elements 52*a* extending into the corresponding through-holes 42. After the bent soldering parts 5225 of the electrical connecting elements 52*a* are soldered, the removable components 51 are removed and the electrical connecting elements 52*a* are left on the printed circuit board 4*a*.

Figure 17:
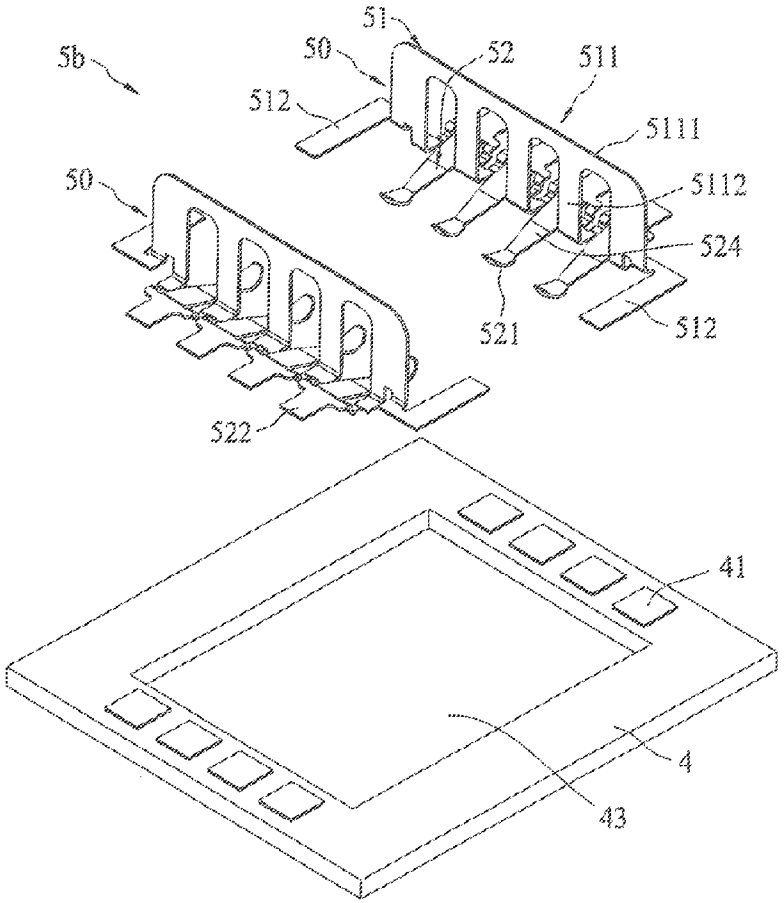
FIG. 17 is a schematic perspective illustration depicting an electrical connecting device mountable on a printed circuit board according to another embodiment.

FIG. 17 is a schematic perspective illustration depicting a bottom mount type electrical connecting device 5*b* mountable underneath a printed circuit board 4 according to another embodiment, wherein the electrical connecting device 5*b* is positioned upside down and the printed circuit board 4 is turned over with its bottom surface facing upward for explanation purposes. As shown in FIG. 17, the electrical connecting device 5*b* is similar to the electrical connecting device 5 of the embodiment shown in FIG. 10. The difference between the electrical connecting devices 5 and 5*b* is that the electrical connecting device 5*b* does not comprise the plate members 53. Thus, the electrical connecting device 5*b* comprises two distinct electrical connecting members 50.

Figure 18:
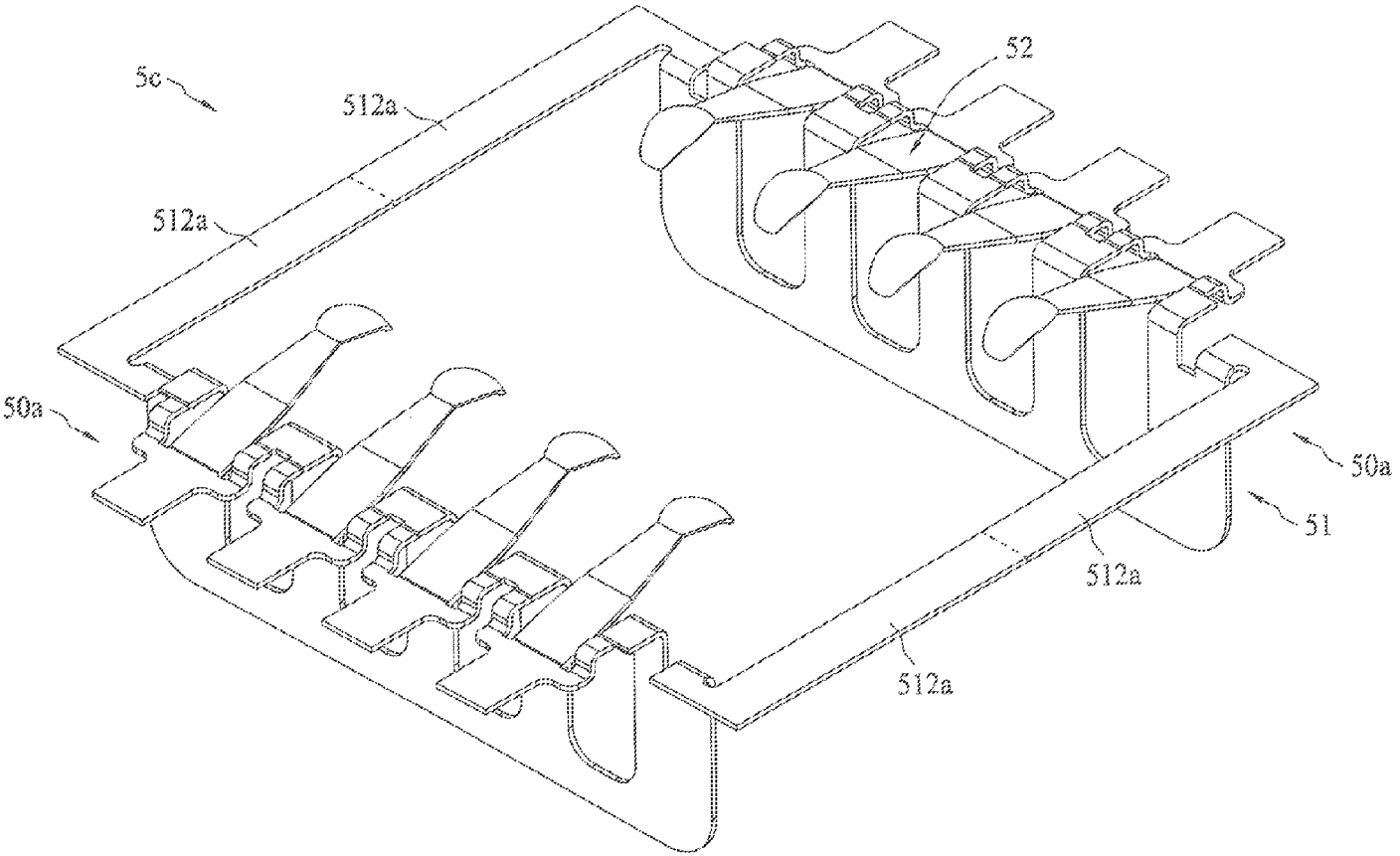
FIG. 18 is a schematic perspective illustration depicting an electrical connecting device according to another embodiment.

FIG. 18 is a schematic perspective illustration depicting an electrical connecting device 5*c* according to another embodiment. As shown in FIG. 18, the electrical connecting device 5*c* comprises electrical connecting members 50*a*. The electrical connecting member 50*a* is similar to the electrical connecting member 50 of the electrical connecting device 5*b* of the embodiment shown in FIG. 17 except that each supporting element 512*a* of one electrical connecting member 50*a* may sufficiently extend and connect to a corresponding supporting element 512*a* of another electrical connecting member 50*a*.

Figure 19:
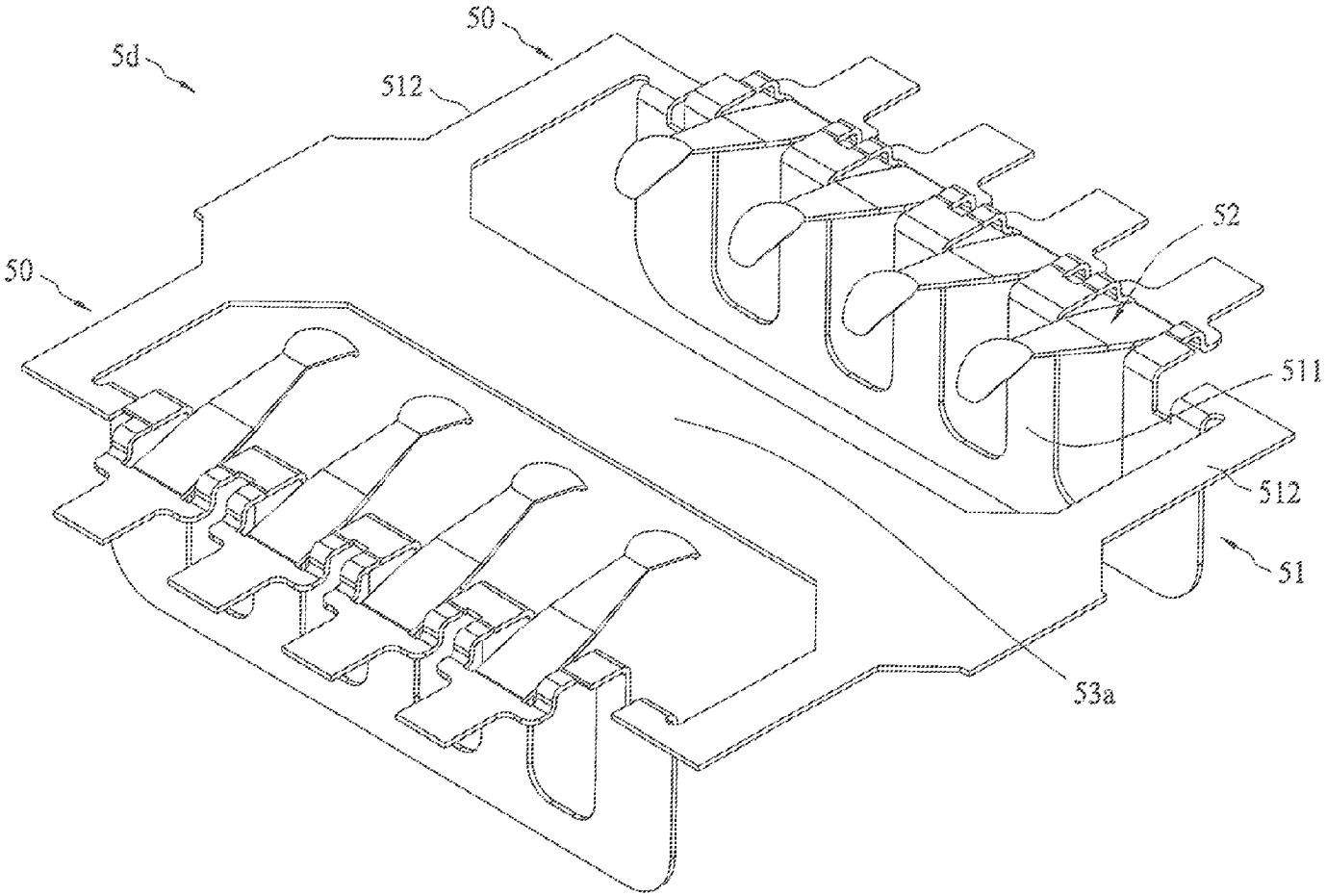
FIG. 19 is a schematic perspective illustration depicting an electrical connecting device according to another embodiment.

FIG. 19 is a schematic perspective illustration depicting an electrical connecting device 5*d* according to another embodiment. As shown in FIG. 19, the electrical connecting device 5*d* and the electrical connecting device 5 are similar, both comprising two electrical connecting members 50 each comprising a plurality of electrical connecting elements 52 and a removable component 51 comprising a comb element 511 and two supporting elements 512. The difference between the electrical connecting devices 5 and 5*d* is that the electrical connecting device 5*d* comprises only one plate member 53*a*, and the two supporting elements 512 of the two removable components 51 are attached to the plate member 53*a*.

Embodiments disclose an electrical connecting device, which may compose an electrical connecting member comprising a plurality of electrical connecting elements configured for electrical connections between two electronic devices, for example, an electronic card and a printed circuit board. The plurality of electrical connecting elements are connected with a removable component, which can be easily separated from the plurality of electrical connecting elements after the electrical connecting elements are soldered, so that the plurality of electrical connecting elements can be simultaneously placed and soldered on a printed circuit board. Accordingly, the assembly process takes less time and is more efficient. In addition, the removable component may comprise a plurality of supporting elements. In some embodiments, the supporting elements are configured to provide a free-standing support to the electrical connecting device such that the electrical connecting device can be free-standing after it is placed on a printed circuit board.

It will be apparent to those skilled in the art that various modifications and variations can be made to the disclosed embodiments. It is intended that the specification and examples be considered as exemplary only, with a true scope of the disclosure being indicated by the following claims and their equivalent.

What is claimed is:

1. An electrical connecting device comprising at least one electrical connecting member comprising:

a plurality of electrical connecting elements arranged along a line and each comprising a base portion comprising opposite first and second edges, two connecting portions respectively formed on opposite ends of the first edge, and an arm portion extending from a location between the opposite ends of the first edge, the arm portion extending upward and along a direction from the second edge to the first edge and comprising a contact part with a contact surface facing upward; and a removable component that includes a comb element comprising a body portion and a plurality of parallel finger portions extending from the body portion, each finger portion connecting to one of the connecting portions of each adjacent one of the electrical connecting elements at a connection that is configured to be breakable and further includes two supporting elements respectively extending from the end portions of two outermost ones of the finger portions of the comb element and along the direction from the second edge to the first edge, wherein the body portion of the comb element is above the two supporting elements, wherein the base portion of the electrical connecting element extends on a plane, and the supporting elements extend adjacent to the plane.

2. The electrical connecting device of claim 1, further comprising a plate member connecting the two supporting elements to form a frame portion.

3. The electrical connecting device of claim 2, comprising two electrical connecting members, wherein the plate members of the two electrical connecting members are connected.

4. The electrical connecting device of claim 1, comprising first and second electrical connecting members, wherein each supporting element of the first electrical connecting member connects to a corresponding one of the supporting elements of the second electrical connecting member.

5. The electrical connecting device of claim 1, wherein the base portion comprises a bottom surface configured as a soldering surface.

6. The electrical connecting device of claim 1, wherein the base portion comprises a bent soldering part.

7. An electrical connecting device comprising:

at least one electrical connecting member including a plurality of electrical connecting elements arranged along a line and each connecting element comprising abuse portion comprising opposite first and second edges, two extending portions bent upward and respectively extending adjacent to opposite ends of the first edge, two connecting portions formed respectively on ends of the two extending portions, and an arm portion extending from a location between the opposite ends of the first edge, the arm portion extending upward and along a direction from the second edge to the first edge and comprising a contact part with a contact surface facing upward; and a removable component including a comb element having a body portion and a plurality of parallel finger portions extending from the body portion, each finger portion connecting to one of the connecting portions of each adjacent one of the electrical connecting elements at a connection that is configured to be breakable and the removable component further including two supporting elements respectively extending from the end portions of two outermost ones of the finger portions of the comb element and along the direction from the second edge to the first edge, wherein the body portion of the comb element is under the two supporting elements, wherein the base portion of the electrical connecting element extends on a plane, and the supporting elements extend adjacent to the plane.

8. The electrical connecting device of claim 7, further comprising a plate member connecting the two supporting elements to form a frame portion.

9. The electrical connecting device of claim 8, comprising two electrical connecting members, wherein the plate members of the two electrical connecting members are connected.

10. The electrical connecting device of claim 7, comprising first and second electrical connecting members, wherein each supporting element of the first electrical connecting member connects to a corresponding one of the supporting elements of the second electrical connecting member.

11. The electrical connecting device of claim 7, wherein the extending portion is configured to comprise an L-shaped arm part.

12. The electrical connecting device of claim 11, wherein the base portion comprises an upper surface configured as a soldering surface.

13. The electrical connecting device of claim 7, wherein the base portion comprises a bent soldering portion.

* * * * *